US010712117B1

(12) United States Patent
Miller

(10) Patent No.: US 10,712,117 B1
(45) Date of Patent: Jul. 14, 2020

(54) PROJECTILE LAUNCHER AND TRIGGER

(71) Applicant: Troy T. Miller, Cumming, GA (US)

(72) Inventor: Troy T. Miller, Cumming, GA (US)

( * ) Notice: Subject to any disclaimer, the term of this patent is extended or adjusted under 35 U.S.C. 154(b) by 0 days.

(21) Appl. No.: 16/436,823

(22) Filed: Jun. 10, 2019

Related U.S. Application Data

(60) Provisional application No. 62/684,066, filed on Jun. 12, 2018.

(51) Int. Cl.
*F41B 3/02* (2006.01)
*A63B 69/00* (2006.01)

(52) U.S. Cl.
CPC ..... *F41B 3/02* (2013.01)

(58) Field of Classification Search
CPC . F41B 3/02; A63B 65/12; A63B 69/40; A63B 69/407; A63B 2208/14
USPC ..... 124/17, 20.1; 119/707
See application file for complete search history.

(56) References Cited

U.S. PATENT DOCUMENTS 300,415 A * 6/1884 Allen ..... F41B 3/02 124/20.1
2,282,315 A * 5/1942 Adams ..... F41B 3/005 124/17
2,357,165 A * 8/1944 Brady ..... F16M 11/42 248/188.7
3,277,878 A * 10/1966 Pankratz ..... A63B 69/407 124/20.1
3,802,409 A * 4/1974 Mike ..... A63B 69/0079 124/20.1
4,784,106 A * 11/1988 Kees ..... F41B 3/005 124/16
4,805,583 A * 2/1989 Mosser ..... A63B 53/00 124/20.1
4,852,543 A * 8/1989 Mosser ..... A63B 53/00 124/20.1
4,873,964 A * 10/1989 Bonoan ..... A63B 65/12 124/20.1
5,123,643 A * 6/1992 Heilhecker ..... A63B 69/407 124/21
5,154,515 A * 10/1992 Haynes ..... A63B 65/127 124/17
5,249,564 A * 10/1993 Peachey ..... A63B 69/40 124/17
5,398,665 A * 3/1995 Carlson ..... A63B 65/12 124/17

(Continued)

*Primary Examiner* — Alexander R Niconovich
(74) *Attorney, Agent, or Firm* — Alexander Legal LLC

(57) ABSTRACT

A projectile launcher apparatus including a trigger assembly, a pair of fork members, a pair of telescopic leg members, a pair of telescopic frame members, and a pouch. The trigger assembly include an actuator, a pair of opposing plates collectively forming a housing therebetween, a trigger lever, a trigger arm and a rolling spacer, wherein the trigger arm applies force against the rolling spacer when the trigger lever engages the trigger arm. The pair of fork members are rotatably attached to the pair of telescopic frame members having a first cross member attached therebetween and to the pair of telescopic leg members having a second cross member attached therebetween. The trigger assembly is attached to the first cross member. The pouch holds a projectile which is launched when the trigger assembly is activated, and the pouch is operatively connected to the trigger assembly.

17 Claims, 9 Drawing Sheets

(56) References Cited

U.S. PATENT DOCUMENTS

| | | | | | |
|---|---|---|---|---|---|
| 5,431,145 | A * | 7/1995 | Strait | A63B 65/122 | 124/17 |
| 5,657,984 | A * | 8/1997 | Leo | A63B 69/407 | 124/17 |
| 5,694,913 | A * | 12/1997 | Parrott | F41B 3/02 | 124/17 |
| 5,996,565 | A * | 12/1999 | Whitmer | A63B 65/12 | 124/17 |
| 6,601,574 | B1 * | 8/2003 | Cole | F41B 3/02 | 124/17 |
| 6,851,675 | B1 * | 2/2005 | Jakubec | A63B 65/12 | 273/355 |
| 6,884,188 | B2 * | 4/2005 | Cherry | A63B 69/407 | 124/17 |
| 7,389,774 | B1 * | 6/2008 | Fonda | F41B 3/02 | 124/20.1 |
| 7,392,801 | B2 * | 7/2008 | McCallister | A63B 21/0552 | 124/17 |
| 7,794,338 | B2 * | 9/2010 | Cherry | A63B 69/40 | 124/17 |
| 2013/0255591 | A1 * | 10/2013 | Shearer | F41B 3/02 | 119/707 |

* cited by examiner

PROJECTILE LAUNCHER AND TRIGGER

CROSS-REFERENCE TO RELATED APPLICATION

This application claims the benefit of priority of U.S. Provisional Application No. 62/684,066 filed on Jun. 12, 2018, the disclosure of which is incorporated herein by reference in its entirety.

FIELD OF THE INVENTION

Embodiments described herein generally relate to the field of projectile launchers and triggers, and more specifically to an improved projectile launcher and trigger.

BACKGROUND OF THE INVENTION

Projectile launchers are known in the art. A projectile launcher may include elastic members (such as tubing) acting as a spring. The tubing may be stretched, and a trigger assembly may be used to initiate launch of the projectile. The trigger assembly may be activated by a pull string or a remotely controlled device. Upon activation of the trigger assembly, the projectile may be launched thereby traveling in an arc trajectory over a distance.

Certain breeds of dogs are bred to retrieve. While this retrieving capability may come naturally to certain dogs, training is nonetheless desirable. Indeed, there are standards-based competitions for evaluating the retrieving capabilities of dogs. Dogs that achieve certain awards or titles from certain organizations are, in turn, more valuable. Accordingly, there is a marketplace for projectile launchers among users such as dog trainers and gun dog enthusiasts.

However, users experience shortcomings with respect to conventional projectile launchers, as described in more detail herein.

BRIEF DESCRIPTION OF THE DRAWINGS

The various advantages of the embodiment of the present disclosure will become apparent to one skilled in the art by reading the following specification and appended claims, and by referencing the following drawing, in which:

SUMMARY OF THE INVENTION

Figure 1:
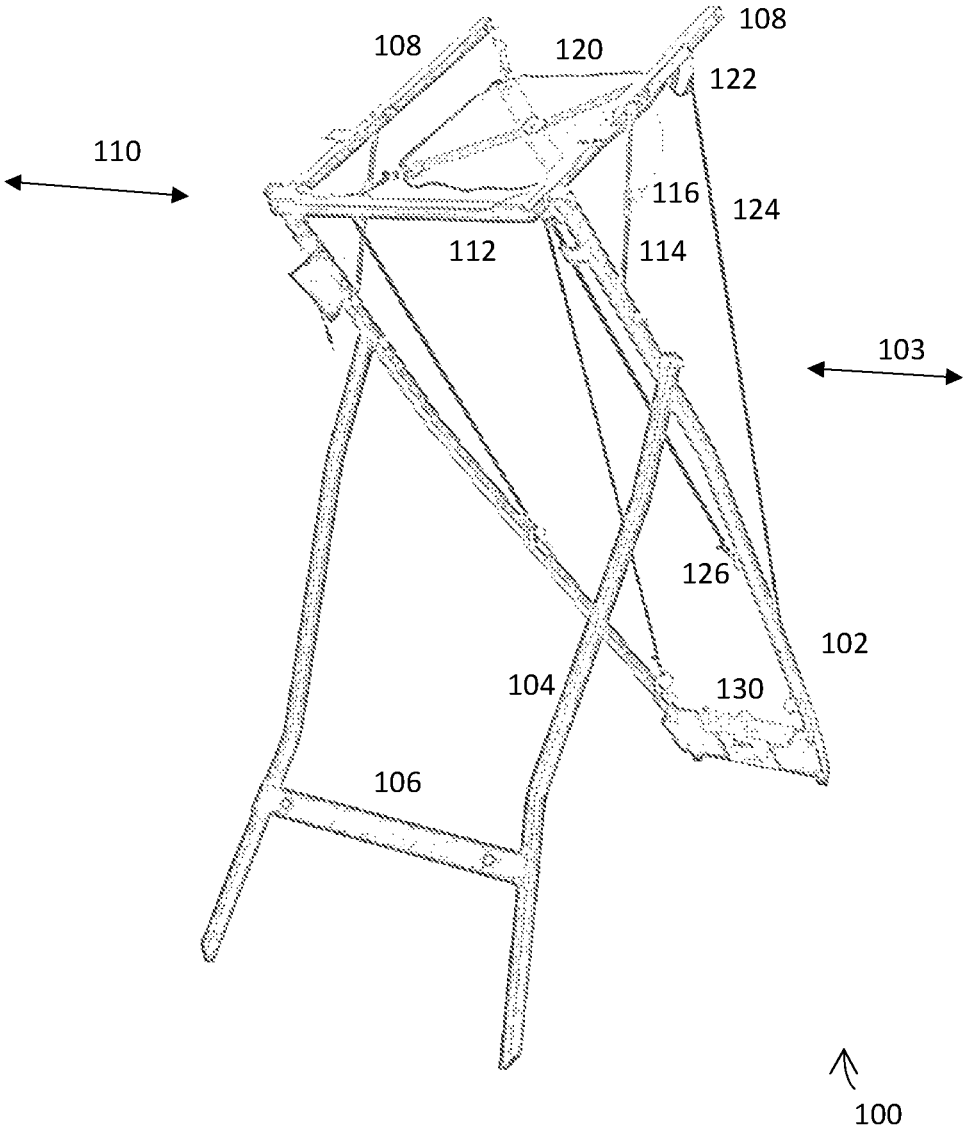
FIG. 1 shows a schematic representation of a conventional full-size projectile launcher.

Exemplary embodiments disclosed herein describe a projectile launcher apparatus including a body, a pair of telescopic leg members, a pair of fork members and a plurality of locking mechanisms. The body is formed by a pair of telescopic frame members having a first cross member extending between the pair of telescopic frame members, wherein the pair of telescopic frame members are collapsed during storage and/or transporting of the apparatus and are extended in an operational mode of the apparatus. The pair of telescopic leg members are rotatably attached to the body. The pair of telescopic leg members having a second cross member extending between the pair of telescopic leg members. The pair of telescopic leg members are collapsed during storage and/or transporting of the apparatus and are extended in an operational mode of the apparatus. The pair of fork members are rotatably attached to the body and to the pair of telescopic leg members. The pair of fork members having a third cross member extending between the pair of fork members. The pair of fork members are oriented in a folded parallel position with the body and the pair of telescopic leg members during storage and/or transporting of the apparatus and are oriented in an unfolded perpendicular position with the body and are oriented in an unfolded semi-perpendicular position with the pair of telescopic leg members in an operational mode of the apparatus. The plurality of locking mechanisms for retaining the telescopic members in an extended position during the operational mode of the apparatus.

In some exemplary embodiments, the pair of telescopic leg members are each rotatably connected to a corresponding fork member at an end of the corresponding fork member opposite from the third cross member.

In some exemplary embodiments, the pair of telescopic frame members are each attached to a corresponding fork member at a midpoint position of the corresponding fork member.

In some exemplary embodiments, the attachment of the pair of telescopic frame members to the pair of fork members is a hingeless attachment.

In some exemplary embodiments, each telescopic member includes one or more slots for slidably positioning the telescopic member.

In some exemplary embodiments, the plurality of locking mechanisms each retain a corresponding telescopic member at a slot position.

In some exemplary embodiments, a top region of the pair of telescopic frame members intersects with the pair of fork members at a midpoint of each of the fork members respectively to create equally distributed elastic load forces about the pair of fork members.

In some exemplary embodiments, the apparatus further comprises a trigger assembly attached to the body, a pouch member, tubing members and tubing connector members.

In some exemplary embodiments, the body includes two tubular members receiving therein the pair of telescopic frame members.

In some exemplary embodiments, the two tubular members have a size larger than the pair of telescopic frame members to enable the two tubular members to receive the pair of telescopic frame members.

In some exemplary embodiments, the pair of telescopic leg members are tubular.

Another exemplary embodiment disclosed herein describes a projectile launcher apparatus including a trigger assembly, a pair of fork members, a pair of telescopic leg members, a pair of telescopic frame members, and a pouch. The trigger assembly include an actuator, a pair of opposing plates collectively forming a housing therebetween, a trigger lever, a trigger arm and a rolling spacer, wherein the trigger arm applies force against the rolling spacer when the trigger lever engages the trigger arm. The pair of fork members are rotatably attached to the pair of telescopic frame members having a first cross member attached therebetween and to the pair of telescopic leg members having a second cross member attached therebetween. The trigger assembly is attached to the first cross member. The pouch holds a projectile which is launched when the trigger assembly is activated, and the pouch is operatively connected to the trigger assembly.

In some exemplary embodiments, the trigger lever is partially located within the housing.

In some exemplary embodiments, the actuator is operatively connected to the trigger lever and causes the trigger lever to pivot about an axis.

In some exemplary embodiments, the actuator is connected to the trigger lever via one or more rings and causes the trigger lever to pivot around at least one bolt when the trigger lever is pulled by the actuator and the one or more rings.

In some exemplary embodiments, the rolling spacer rolls off of the trigger arm and disengages the trigger arm when the trigger lever pivots about the axis.

In some exemplary embodiments, the pouch is attached to tubing and the tubing is extended when the pouch is pulled down and attached to the trigger assembly thereby creating energy that is released when the trigger assembly is activated.

In some exemplary embodiments, the pouch is pulled towards the pair of fork members when the trigger assembly is activated thereby launching the projectile.

DETAILED DESCRIPTION

Reference will now be made in detail to embodiments of the present invention, examples of which are illustrated in the accompanying drawings, wherein like reference numerals refer to the like elements throughout. The embodiments are described below to explain the present invention by referring to the figures.

As used in the description of this application, the terms "a", "an" and "the" may refer to one or more than one of an element (e.g., item or act). For example, references to "bolt" may refer to one or more than one bolt. Similarly, a particular quantity of an element may be described or shown while the actual quantity of the element may differ. For example, although two opposing plates may be shown or described, a different number of plates may be provided. The terms 11 and" and II or" may be used in the conjunctive or disjunctive sense and will generally be understood to be equivalent to "and/or". Elements from an embodiment may be combined and substituted with elements of another.

Elements described as separate elements may be combined into a single element. For example, although two opposing plates are described, it is conceivable that a single plate may be provided and pressed into two separate sides of a same plate. Similarly, an element described as single element may be split into two or more elements. No element used in the description of this application should be construed as critical or essential to the invention unless explicitly described as such. Further, when an element is described as II connected," 11 coupled," or otherwise linked to another element, it may be directly linked to the other element, or intervening elements may be present.

Figure 2:
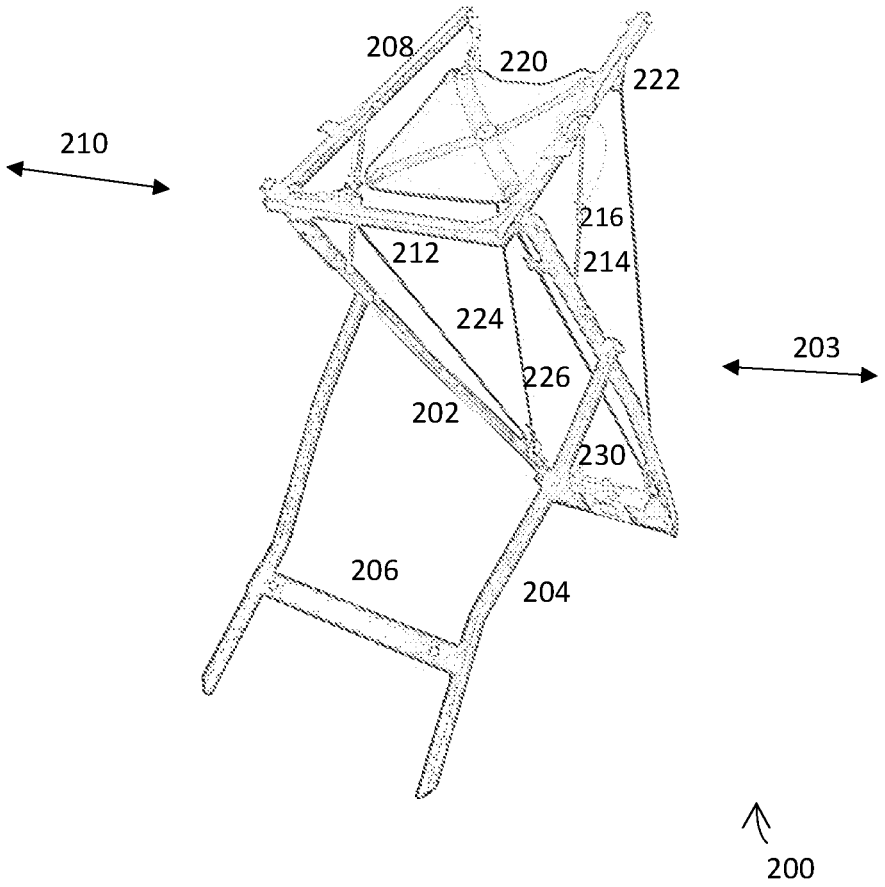
FIG. 2 shows a schematic representation of a conventional compact projectile launcher.

As noted above, the present disclosure has identified shortcomings with respect to conventional projectile launchers. For example, conventional designs have inherent design flaws. Additionally, certain user frustrations exist with respect to reliability, performance, and ease of use. To more carefully consider these flaws and frustrations, exemplary conventional projectile launchers are shown in FIG. 1 and FIG. 2 and are reviewed. More specifically, a conventional full-size projectile launcher 100 is shown in FIG. 1. A conventional compact projectile launcher 200 is shown in FIG. 2.

The conventional full-size projectile launcher 100 includes a body 102 which serves as the frame for the full-size projectile launcher 100. Legs 104 may be rotatably attached to the body 102 about a leg axis 103 from a middle position along the body 102 and end portions of the legs 104, and a cross member 106 may be provided between legs 104. Legs 104 may be rotated about the leg axis 103 from extending parallel along the frame of the body 102 during storage and/or transportation to extending outward and downward from the leg axis 103 at approximately 30 to 60 degrees relative to the body 102 during operation.

Forks 108 may be rotatably attached to the body 102 about a fork axis 110 at an end of the body 102 and ends of the forks 108, and a cross member 112 may be provided between the forks 108. Forks 108 may be rotated about the fork axis 110 from extending parallel along the frame of the body 102 during storage and/or transportation to outward and upward from the fork axis 110 at approximately 90 degrees relative to the frame of the body 102 during operation. Folding hinges 114 may be connected to a middle portion of the forks 108 and a portion of the frame of the body 102 and may be extended fully when the forks 108 are in the operable position. Importantly, it is noted that this conventional design requires the use of a hinge pin 116 may be placed in the extended hinges 114 to lock the forks 108 in their extended operable position.

The conventional full-size projectile launcher 100 may further include a pouch 120, pulleys 122, tubing 124 and hooks 126. The tubing may be elastic rubber and is sometimes referred to as springs or bungees. Pouch 120 may further include a pouch ring (not shown) that, in operation, may be connected to a trigger assembly 130 attached to body 102. The pouch may be connected to the tubing 124, which may be wound around pulleys 122 and connected to hooks 126. When the pouch 120 is pulled down and attached to the trigger assembly 130, the tubing is extended thereby creating potential energy that is released when the trigger assembly 130 is activated thereby pulling the pouch 120 towards the forks 108 thereby launching the projectile.

Turning to FIG. 2, the conventional compact projectile launcher 200 may be similar to the conventional full-size projectile launcher 100. That is, the compact projectile launcher 200 may include a body 202 (frame), legs 204 rotatably attached to body 202 about a leg axis 203, and a cross member 206 may be provided between legs 204. Legs 204 may rotate about leg axis 203 from a storage position to an operational position. Forks 208 may be rotatably attached to the body 202 about a fork axis 210 at an end of the body and at ends of the forks 208, and a cross member 212 may be provided between the forks 208. Like the full-size embodiment, the conventional compact projectile launcher 200 may include folding hinges 214 that may be connected to middle portion of the forks 208 and a portion of the frame of the body 202, and hinge pins 216 may be placed in the extended hinges 214 to lock the forks 208 in their extended operable position.

The conventional compact projectile launcher 200 may further include a pouch 220 with pouch ring that, in operation, may be attached to trigger assembly 230. The pouch 220 may be connected to tubing 224, which may be wound around pulleys 222 and connected to hooks 226. When pouch 220 is pulled down and attached to trigger assembly 230, the extended tubing may create potential energy that is released when trigger assembly 230 is activated thereby pulling the pouch 220 towards the forks 208 thereby launching the projectile.

Conventional projectile launchers 100, 200 represent compromises. The further elastic tubing is stretched, the more potential energy, and the further a projectile can be launched. However, longer tubing necessitates a body 102 that is longer resulting in the full-size projectile launcher 100, that happens to be more difficult to transport and store. The compact projectile launcher 200 is smaller and therefore easier to transport and store, but its elastic tubing cannot be stretched as far and therefore does not launch the projectile as far. Thus, there is a compromise between size and performance.

Further user frustrations with conventional projectile launchers 100,200 include bent and broken hinges, a result of forgetting to properly place the hinge pins 116, 216 so as to set the extended hinges 114,214 for use. Hinge pins 116,216, hinges 114,214, and other elements may be lost or break, and may need to be replaced at a cost to a user. Another frustration includes user injury that may result from not properly placing the hinge pins 116, 216. Because the legs 104, 204 rotate freely about the leg axis and because during launch there are excessive moment forces about the fork axis 110, 210, a conventional launcher 100, 200 may collapse or fail after being fired unless legs 104,204 (and in some cases portions of body 102,202) are staked into the ground. Further, the inherent permanent process (welding) used, e.g., to assemble the legs 104, 204 to the cross member 106, 206, the legs 104, 204 to the trigger assembly 130, 230, as well as the forks 106, 206, make disassembly and replacement of worn or damaged parts cumbersome.

A further user frustration is with conventional trigger mechanisms. Conventional trigger mechanism actuation is inefficient. A projectile launcher may be under 80 to 100 pounds of force necessitating a certain amount of voltage to release the trigger. When voltage is low (i.e., when a battery in trigger electronics is low), trigger force is lowered, and a trigger may fail to be activated when desired by a user. Further, the inefficiencies of the design of the trigger mechanism may consume energy due to, e.g., friction.

The present disclosure describes an improved projectile launcher that can launch projectiles accurately over great distances, that is compact for transportation and storage, that is easier to use, that requires less repairs, that is easier and more affordable to repair when necessary. The improved projectile launcher takes advantage of a telescoping frame and telescoping legs and a novel fork and leg configuration, the combination of which enable benefits such as the projectile launcher being foldable flat and compact when transported or stored and improved performance when in an operational state.

The improved projectile launcher further may include an improved trigger assembly. The improved trigger assembly is a low friction design taking advantage of roller design. Battery-life may be prolonged. Further, reliability of the trigger assembly may be improved. As with the rest of the improved projectile launcher, the improved trigger assembly may be more affordable to manufacture and maintain. For example, many elements may be easily and affordably formulated from widely available materials.

Figure 3:
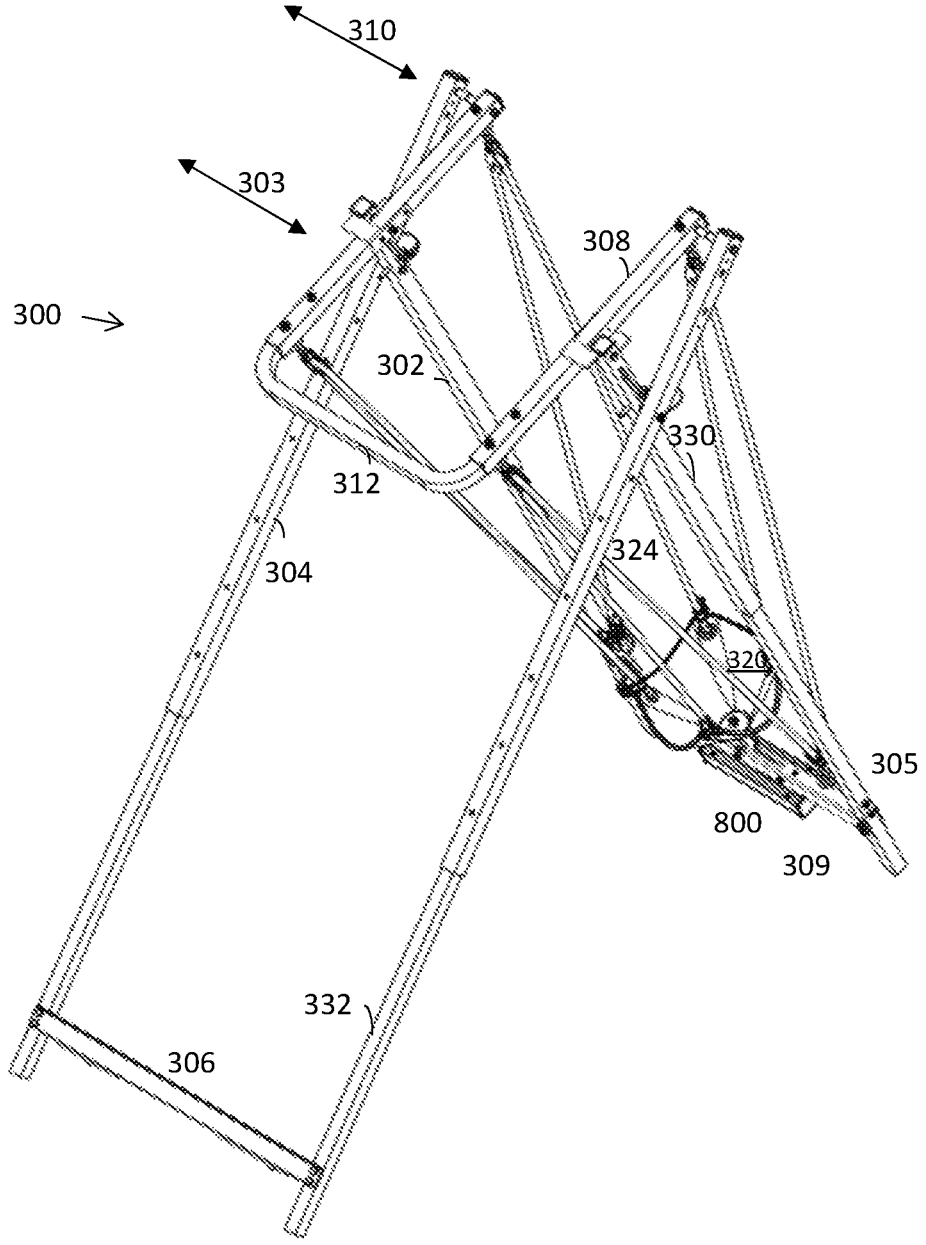
FIG. 3 shows a front schematic perspective of an improved projectile launcher according to an exemplary embodiment of the present invention, where the projectile launcher is in an operational state.
Figure 4:
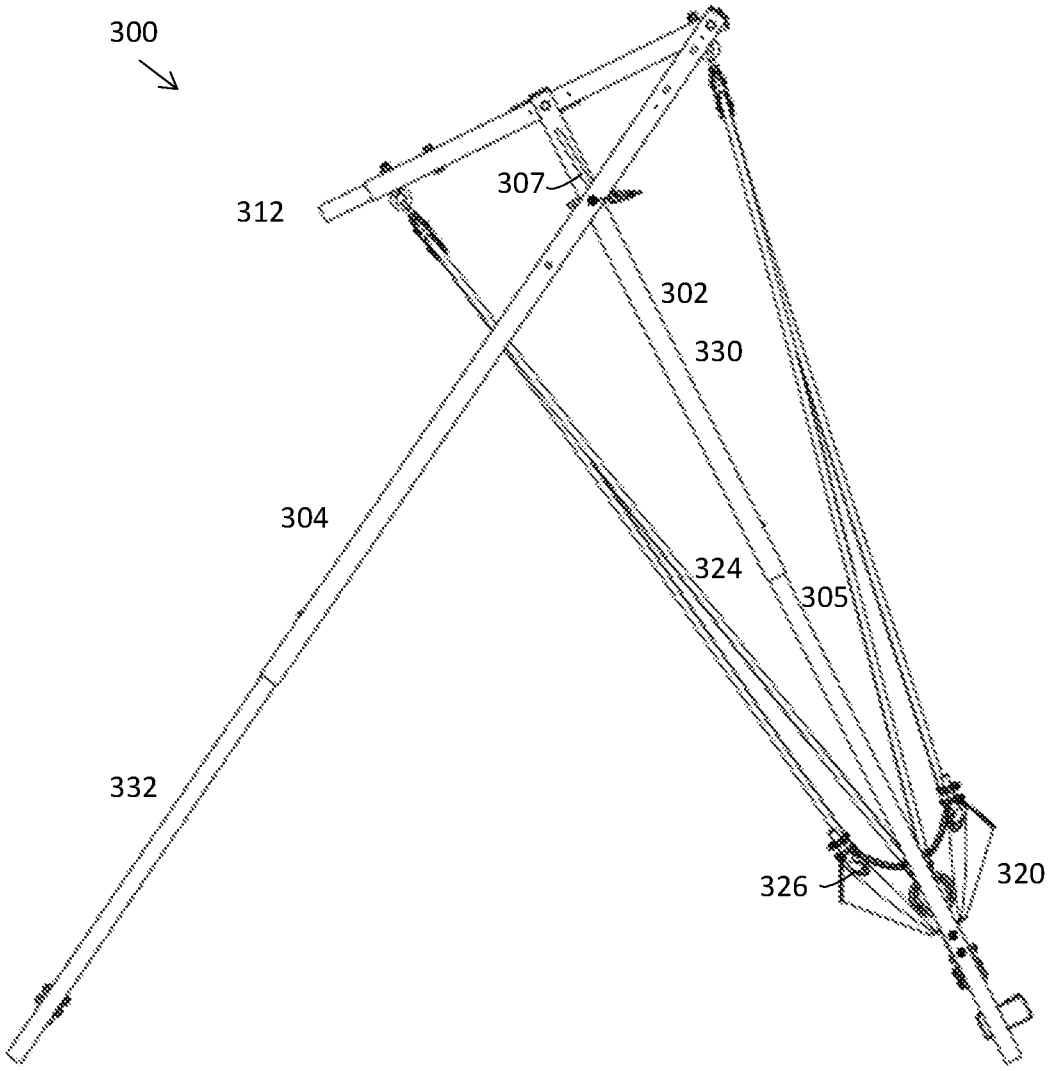
FIG. 4 shows a schematic view of the improved projectile launcher of FIG. 3.
Figure 5:
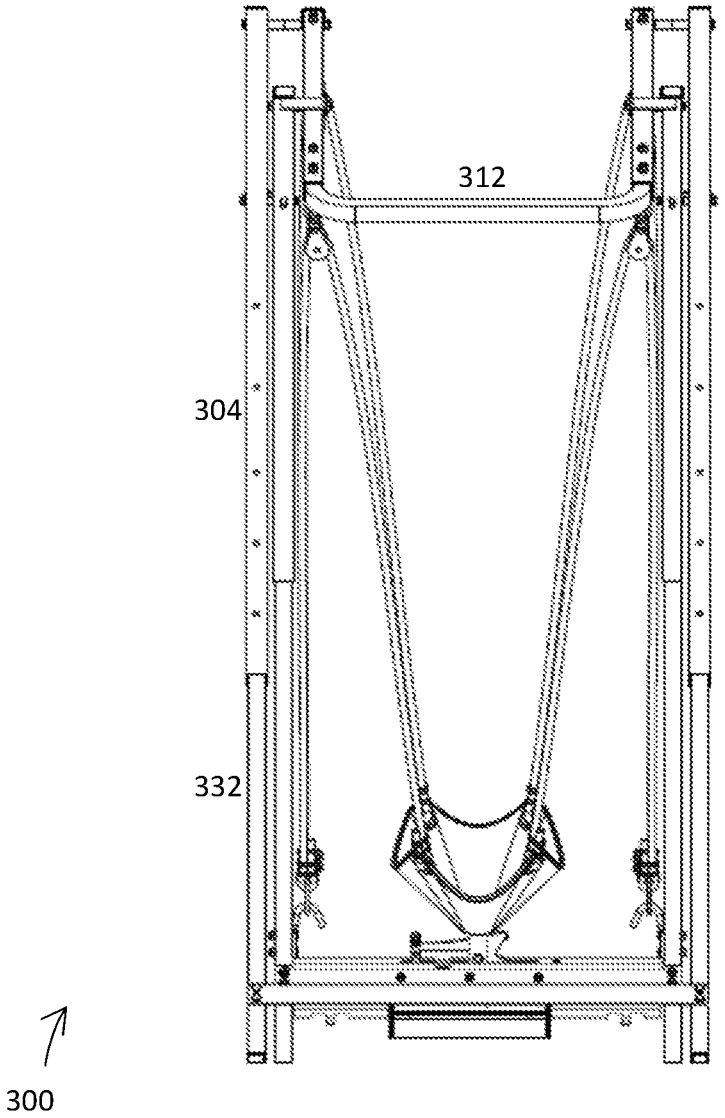
FIG. 5 shows a schematic front view of the improved projectile launcher of FIG. 3.
Figure 6:
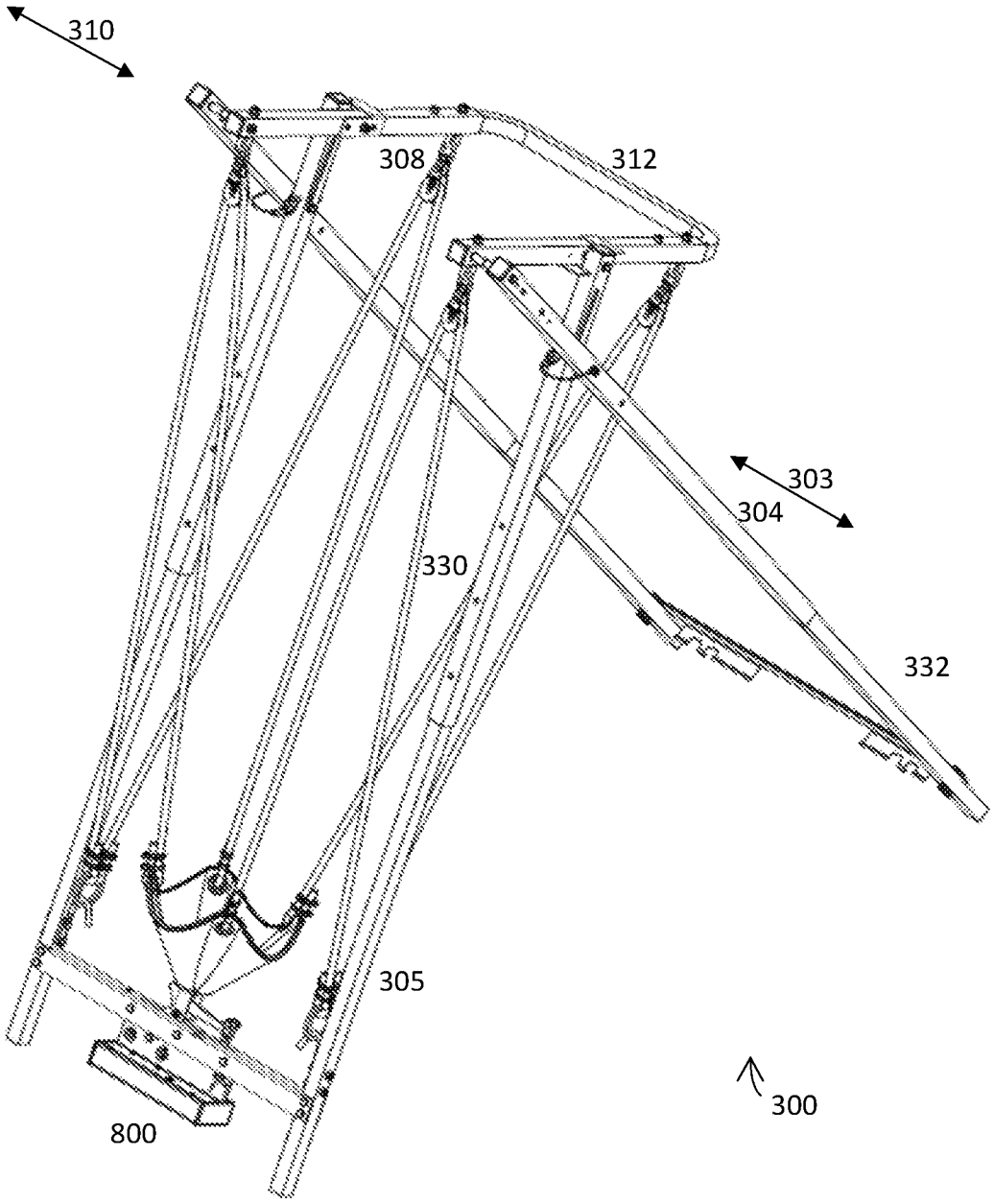
FIG. 6 shows a rear schematic perspective view of the improved projectile launcher of FIG. 3.
Figure 7:
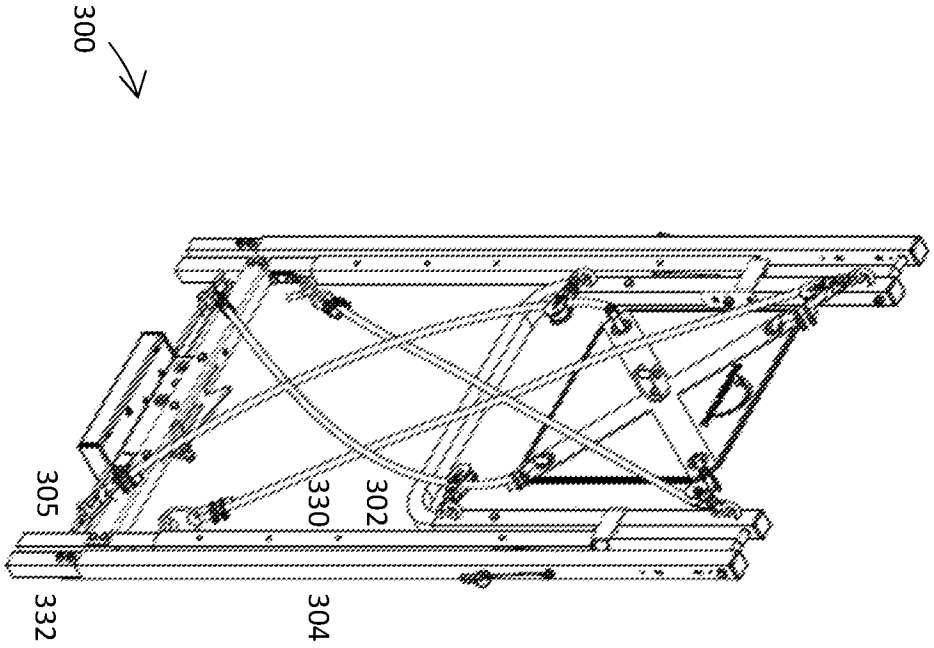
FIG. 7 shows a schematic perspective view of the improved projectile launcher of FIG. 3, where the projectile launcher is in a collapsed state.

Turning back to the figures, FIG. 3 is a schematic front perspective view of an improved projectile launcher 300 according to an exemplary embodiment of the present invention, where the projectile launcher 300 is in an operational state. FIG. 4 is a schematic side view of the improved projectile launcher 300 of FIG. 3. FIG. 5 is a schematic front view of the improved launcher 300 of FIG. 3. FIG. 6 is a rear perspective view of the improved launcher 300 of FIG. 3. FIG. 7 is a schematic perspective view of the improved launcher 300 of FIG. 3, where the projectile launcher is in a collapsed state.

The projectile launcher 300 may include a body 302 which may serve as the frame for the projectile launcher 300. The body 302 may include telescoping frame members 305 and a cross member 309 extending between telescoping frame members 305. The projectile launcher 300 may include legs 304 and forks 308. The legs 304 may be rotatably attached to the body 302 about a slidable leg axis 303 as well as rotatably attached to forks 308. The projectile launcher 300 may include a cross member 312, which may connect forks 308.

At least some of the components of the projectile launcher 300 (e.g., the body, the legs, the forks, and the cross member) may be formed from steel so as to facilitate easy manufacture by, e.g., a metal pressing process).

The body 302 or frame may include two tubular members 330 receiving therein the two telescoping frame members 305. The two tubular members 330 may be square tubing of a first size. The two telescoping frame members 305 may be square tubing of a second size. The first size may be larger than then second size to enable the two tubular members 330 to receive therein the two telescoping frame members 305. Alternative embodiments may provide rectangular tubing, round tubing, or where the first size is less than the second size. The body may further include the cross member 309.

Fasteners may be used to stop sliding of the two telescoping frame members 305 within the two tubular members 330. The fasteners may include snap spring buttons. The cross member 309 may extend between the telescoping frame members 305 and may be rectangular tubing a size comparable to the telescoping frame members 305. The cross member 309 may provide a method of connection between both telescoping frame members 305 to ensure coincidental linear translation of the telescoping frame members 305. The cross member 309 may mount a trigger assembly 500 (described below).

The projectile launcher 300 may include legs 304. Legs 304 may be rotated about the slidable leg axis 303 within slots 307 near an end of the body 302 and positions along the top half of the legs 304. Legs 304 may be rotated about the slidable leg axis 303 from extending parallel along the frame of the body 302 during storage and/or transportation to extending outward and downward from the slidable leg axis 303 at approximately 50 to 70 degrees relative to the frame of the body 302 during operation.

Legs 304 and forks 308 may be connected at fork axis 310, slidable leg axis 303, and along slots 307, enabling coincidental rotation about the axes, resulting in folding or unfolding of the projectile launcher 300 by a single user movement of one or more of the body 302, legs 304, or the forks 308. That is, the design of each side is of body 302, legs 304, and forks 308 joined by three pins or bolts. One of the pins is slotted (307) to act as a cam, the geometry of which is bounded by the radius of fork 308 from the slotted pin. This design limits rotational movement and eliminates the need for a hinge as in the conventional designs. Legs 304 may slide up in slots 307 during storage and/or transportation.

Legs 304 may be tubular and receive therein two telescoping tubular leg members 332. The legs 304 may be square tubing of the first size and the two telescoping tubular leg members 332 may be square tubing of the second size. Alternatives in terms of size and configuration may be similar to those described above with respect to the two tubular members 330 and the body 302. A cross member 306 may be provided between the two telescoping tubular leg members 332. Fasteners may be used to stop sliding of the two telescoping tubular leg members 332 within the two legs 304. The fasteners may include snap spring buttons.

The projectile launcher 300 may include forks 308. A cross member 312 may connect forks 308. Forks 308 may be rotated about fork axis 310 from extending parallel along body 302 during storage and/or transportation to outward and downward from the fork axis 310 at approximately 15 to 50 degrees relative to the frame of the body 302 during operation. When the forks 308 are extended in an operational state, legs 304 may be simultaneously slid down in slots 307.

It should be noted that when in an operational state, the top of the frame members forming the body 302 intersect with the forks 308 at a midpoint of each of the forks 308, and not at an endpoint of the forks as in the conventional design. By moving the pivot point to the center of the upright, elastic load forces are equally distributed about the fork 308 at the slidable leg axis 303 when loaded. Accordingly, the improved projectile launcher 300 will not try to retract upon itself, that is, the forks will not try to fold from an operational position.

In the improved projectile launcher 300, there are no hinges necessary along with pins to be forgotten, which is far less dangerous in that the typical 85-100 pounds of force will not destroy unpinned hinges and potentially harm users. Further, in conventional designs, the entire device may try to lunge forward (and over itself) due to the design therefore requiring staking of the legs into the ground. In the present design, the forces do not have such an effect. The state of equalized and offset forces inherent in the design of the improved projectile launcher 300 eliminate any tendency of the apparatus to fold upon itself while loaded. This tendency to fold is evident in the conventional launchers as a result moment created by the location of the pivot point of the forks in relation to the elastic load forces.

The projectile launcher 300 may further include a pouch 320, tubing 324 and tubing connections 326 (such is eye hooks). Tubing may be elastic rubber. In an alternative embodiment, tubing may be an alternative elastic material. Pouch 320 may further include a roller yoke 340 that, in operation, may be connected to a trigger assembly, such as trigger assembly 500 of FIG. 5. In an embodiment, roller yoke 340 may be "U" shaped having a roller 342 therebetween retained by a bolt 344 or pin.

The surface of the roller yoke 340 perpendicular to the ends of the roller yoke may include a hole 346 or other mechanism to secure the roller yoke 340 to the pouch 320. In an embodiment, roller yoke 340 may be formed from steel so as to facilitate easy manufacture by, e.g., a metal pressing process. Roller 342 may be formed of nylon. When the pouch 320 is pulled down and attached to the trigger assembly, the tubing may be extended thereby creating potential energy that is released when trigger assembly is activated thereby pulling the pouch 320 towards the forks 308 thereby launching a projectile.

It should be noted that using the present design, a projectile is more likely to be released from the pouch 320. More particularly, the design of the forks 308 and the pouch 320 creating equilibrium is more likely to launch a projectile without an accidental contact being made between the projectile and the forks 308 or the cross member 312. This leads to a more consistent and accurate launch, each launch.

Figure 8:
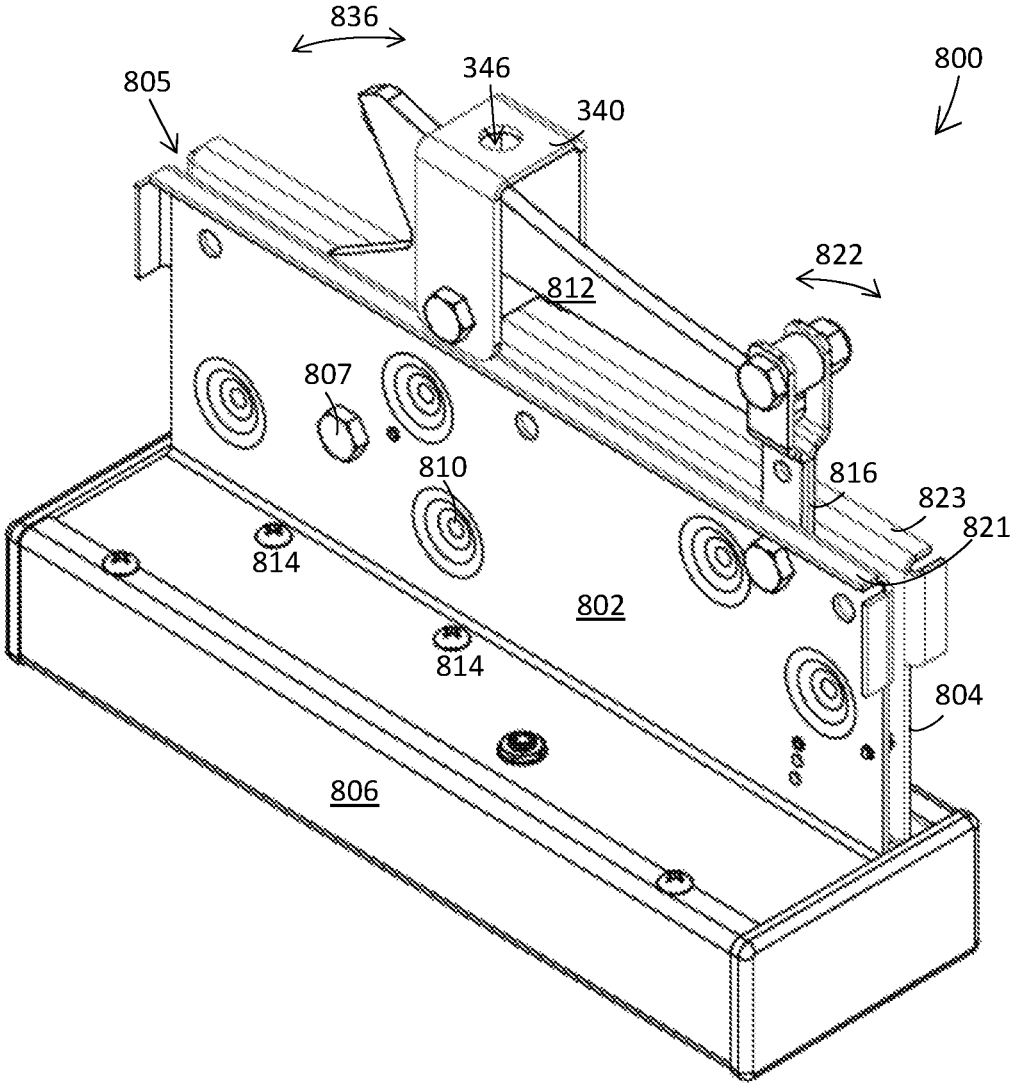
FIG. 8 shows a schematic perspective view of an improved trigger assembly according to an exemplary embodiment of the present invention.

As noted above, the improved projectile launcher 300 may include a trigger assembly, such as the improved trigger assembly 800 of FIG. 8. For example, the trigger assembly may be mounted to or integral with the cross member 309.

Figure 9:
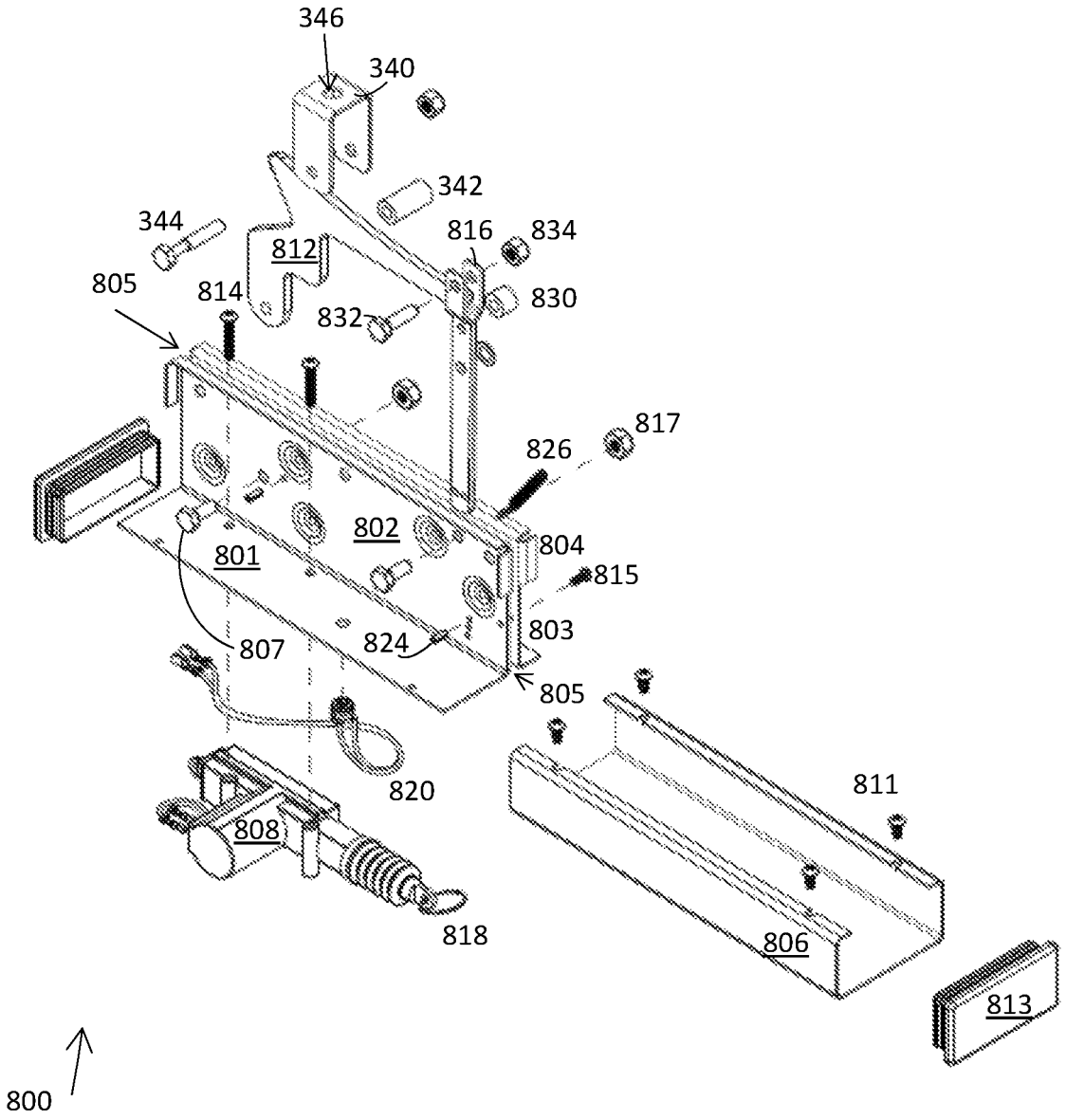
FIG. 9 shows an exploded schematic view of the improved trigger assembly of FIG. 8.

FIG. 8 is a schematic perspective view of an improved trigger assembly 800 according to an exemplary embodiment of the present invention. FIG. 9 is an exploded schematic view of the improved trigger assembly 800 of FIG. 5. The trigger assembly 800 may include two opposing plates 802, 804 juxtaposed next to each other, spaced apart, thereby defining a trigger housing 805. The trigger assembly 800 may include a cover 806 housing an actuator 808 ultimately in communication with trigger arm 812.

At least some of the components of the trigger assembly 800 (e.g., the opposing plates 802, 804, and the cover 806) may be formed from steel so as to facilitate easy manufacture by, e.g., a metal pressing process.

The two opposing plates 802, 804 may be secured to each other but spaced apart from one another defining a trigger housing 805 therebetween. In an embodiment, a first 802 (also referred to herein as first plate) of the two plates may include one or more raised portions 810 (i.e., emboss points or indents) which may act as spacers between the first 802 and a second 804 of the two plates. In an embodiment, raised portions 810 of the first plate 802 may be sufficient to provide the desired space defining the trigger housing 805.

In another embodiment, the second 804 (also referred to herein as second plate) of the two plates may include one or more raised portions (not shown) which may act as spacers between the first 802 and second 804 of the two plates. The raised portions of the first and second plates may form a mirror image so that the raised portions of each of the plates 802, 804 abut each other thereby providing the desired space defining the trigger housing 805. Alternatively, raised portions of the first and second plates 802, 804 may be offset relative to one another thereby providing the desired space defining the trigger housing 805. In yet a further alternative embodiment, separate spacers may be used to provide the desired space defining trigger housing.

In an embodiment, the two opposing plates 802, 804 may be welded together (e.g., spot welded) at raised portions 810, such as where raised portions 810 of the two opposing plates 802, 804 abut each other. In another embodiment, plates 802, 804 may be held together by fasteners, at raised portions 810 or elsewhere. In an embodiment, plates 802, 804 may be secured to each other by one or more of bolts 807, appropriate nuts 817, and a screw 815.

The two opposing plates 802, 804 may each include a lower flange 801, 803. Lower flanges 801, 803 may be fastened to cover 806 by screws 811. Ends of cover 806 may be covered by plugs 813. In an embodiment, plugs may be formed of rubber. The two opposing plates 802 may each include an upper flange 821, 823. Flanges 821, 823 may provide surface contact to mating surface of cross member 309 to ensure secure fit between trigger assembly 800 and the cross member 309. Additional side flanges may be provided.

Actuator 808 may be attached to lower flange 801 of the first plate 802 by screws 814. In an embodiment, actuator 808 may be a standard 12-volt door-lock actuator. In an alternative embodiment, a different type of actuator or motor may be used. Actuator 808 may be operably connected to a trigger lever 816. In an embodiment, trigger lever 816 may be yoke or "Y" shaped having a single lower member attached to two upper members. Actuator 808 may be connected to trigger lever 816 via direct attachment or via a fastener such as one or more rings 818. Actuator 808 may be connected via wiring 820 to an appropriate electric signal generator such as a wireless electronic signal generator.

Trigger lever 816 may pivot 822 around one of the bolts 807 when pulled by actuator 808 and ring 818. When in a resting state, trigger lever 816 may be return to its initial position by spring 826 and ring, and rest against one (or more) pins 824. Pivoting 822 about bolt 807 against the resistance provided by spring 826 provides only a necessary amount of resistance that is easily overcome by actuator 808.

The two upper members of trigger lever 816 may include a rolling spacer 830 therebetween mounted by bolt 832 and nut 834. Rolling spacer 830 may roll off of trigger arm 812 when trigger lever 816 is pulled from its initial position by actuator 808. Roller 830 rolling off trigger arm 812 provides minimal resistance easily overcome by actuator 808.

Trigger arm 812 may be mounted by and pivot 836 about one of the bolts 807. When a pouch (such as pouch 320 of FIG. 3) is pulled down and attached to trigger assembly 800 (specifically, trigger arm 812), extended tubing may create potential energy that is released when trigger assembly 800 is activated thereby pulling the pouch towards forks thereby launching a projectile within the pouch. Upward pressure may exist against rolling spacer 830 passing over the top of a catch portion of the trigger arm 812 when trigger lever 816 is in its initial position. When actuator 808 is actuated, ring 818 is pulled thereby pulling trigger lever 816, which thereby rolls rolling spacer 830 off catch portion of the trigger arm 812, thereby releasing potential energy of extending tubing.

By using rolling spacer 830 and the disclosed pivot design, trigger forces are minimized.

The foregoing description discloses only exemplary embodiments of the invention. Modifications of the above-disclosed embodiments of the present invention (beyond those modifications already mentioned) of which fall within the scope of this disclosure will be readily apparent to those of ordinary skill in the art. For example, although opposing plates are described, an alternative embodiment using a single plate is contemplated and should be considered to be within the scope of this disclosure.

Accordingly, although embodiments of the present invention have been shown and described, it would be appreciated by those skilled in the art that changes may be made in these embodiments without departing from the principles and spirit of the invention.

What is claimed is:

1. A projectile launcher apparatus comprising:

a body which is formed by a pair of telescopic frame members and a pair of frame tubular members, the pair of telescopic frame members having a first cross member extending between the pair of telescopic frame members near a bottom end of the pair of telescopic frame members and each telescopic frame member having a respective frame tubular member attached to its top end, wherein the pair of telescopic frame members are collapsed during storage and/or transporting of the apparatus by sliding inward each telescopic frame member into the respective attached frame tubular member and are extended in an operational mode of the apparatus by sliding outward each telescopic frame member out from within the respective attached frame tubular member;

a pair of telescopic leg members which are rotatably attached to the body, the pair of telescopic leg members having a second cross member extending between the pair of telescopic leg members near a bottom end of the pair of telescopic leg members and each telescopic leg member having a leg tubular member attached to its top end and each leg tubular member is attached to a respective one of the pair of frame tubular members, wherein the pair of telescopic leg members are collapsed during storage and/or transporting of the apparatus by sliding each telescopic leg member into a respective attached leg tubular member and are extended in an operational mode of the apparatus by pulling each telescopic leg member out from within the respective attached leg tubular member;

a pair of fork members which are rotatably attached to the pair of frame tubular members and to the leg tubular members, each fork member is attached to a corresponding one of the frame tubular members and to a corresponding one of the leg tubular members, the pair of fork members having a third cross member extending between the pair of fork members, wherein the pair of fork members are oriented in a folded parallel position with the body and the pair of telescopic leg members during storage and/or transporting of the apparatus and are oriented in an unfolded perpendicular position with the body and are oriented in an unfolded semi-perpendicular position with the pair of telescopic leg members in an operational mode of the apparatus; and a plurality of locking mechanisms for retaining the telescopic members in an extended position during the operational mode of the apparatus.

2. The apparatus of claim 1, wherein the pair of leg tubular members are each rotatably connected to a corresponding fork member at an end of the corresponding fork member opposite from the third cross member.

3. The apparatus of claim 1, wherein the pair of frame tubular members are each attached to one of the pair of fork members at a midpoint position of the fork member to create equally distributed elastic load forces about the pair of fork members.

4. The apparatus of claim 3, wherein the attachment of the pair of frame tubular members to the pair of fork members is a hingeless attachment.

5. The apparatus of claim 1, wherein each of frame tubular members and leg tubular members include a plurality of slots and pinned locations such that the motion of is limited to the useful range.

6. The apparatus of claim 5, wherein the plurality of locking mechanisms each retain a corresponding telescopic member at a slot position.

7. The apparatus of claim 1, further comprising a trigger assembly attached to the body, a pouch member, tubing members and tubing connector members.

8. The apparatus of claim 1, wherein the pair of frame tubular members have a size larger than the pair of telescopic frame members to enable the pair of frame tubular members to receive the pair of telescopic frame members.

9. The apparatus of claim 1, wherein the pair of telescopic leg members are tubular.

10. The apparatus of claim 1, wherein each fork member is attached to a corresponding leg tubular member at a fork axis and a slideable leg axis, and each frame tubular member is attached to a corresponding fork member at a pivot point, thereby enabling coincidental rotation about the axes and limiting the linear and rotational motion to the useable extended and folded states of the apparatus.

11. A projectile launcher apparatus comprising:

a trigger assembly including an actuator, a pair of opposing plates collectively forming a housing therebetween, a trigger lever, a trigger arm and a rolling spacer, the trigger lever having a single lower member attached to two upper members, the two upper members having the rolling spacer mounted therebetween, wherein the trigger arm applies force against the rolling spacer when the trigger lever engages the trigger arm, and wherein the pair of opposing plates each include one or more spacer indents to create a desired space to allow free motion of the trigger lever, trigger arm and other components, herein defining the trigger housing;

a pair of fork members which are rotatably attached to a pair of telescopic frame members having a first cross member attached therebetween and to a pair of telescopic leg members having a second cross member attached therebetween, wherein the trigger assembly is attached to the first cross member; and a pouch for holding a projectile which is launched when the trigger assembly is activated, wherein the pouch is operatively connected to the trigger assembly.

12. The apparatus of claim 11, wherein the trigger lever is partially located within the housing.

13. The apparatus of claim 11, wherein the actuator is operatively connected to the trigger lever and causes the trigger lever to pivot about an axis.

14. The apparatus of claim 13, wherein the actuator is connected to the trigger lever via one or more rings and causes the trigger lever to pivot around at least one bolt when the trigger lever is pulled by the actuator and the one or more rings.

15. The apparatus of claim 13, wherein the rolling spacer rolls off of the trigger arm and disengages the trigger arm when the trigger lever pivots about the axis.

16. The apparatus of claim 11, wherein the pouch is attached to tubing and the tubing is extended when the pouch is pulled down and attached to the trigger assembly thereby creating energy that is released when the trigger assembly is activated.

17. The apparatus of claim 11, wherein the pouch is pulled towards the pair of fork members when the trigger assembly is activated thereby launching the projectile.

* * * * *